United States Patent [19]

Barton

[11] Patent Number: 5,056,736

[45] Date of Patent: Oct. 15, 1991

[54] INFORMATION TRANSMISSION SYSTEM

[75] Inventor: Arthur E. M. Barton, Bristol, England

[73] Assignee: British Aerospace PLC, London, England

[21] Appl. No.: 110,590

[22] Filed: Oct. 19, 1987

Related U.S. Application Data

[63] Continuation of Ser. No. 795,448, Nov. 6, 1985, abandoned.

[51] Int. Cl.[5] ..... G01S 1/70

[52] U.S. Cl. ..... 244/3.13; 244/3.16; 359/142

[58] Field of Search ..... 455/605, 607, 606, 617; 244/3.13, 3.16; 356/152

[56] References Cited

U.S. PATENT DOCUMENTS

| | | | |
|---|---|---|---|
| 3,566,126 | 2/1971 | Lang | 455/607 |
| 3,710,122 | 1/1973 | Burcher et al. | 455/606 |
| 3,828,185 | 8/1974 | Vandling | 455/605 |
| 3,893,772 | 7/1975 | Le Tilly et al. | 455/606 |
| 3,954,340 | 5/1976 | Blomqvist et al. . | |
| 3,997,762 | 12/1976 | Ritchie et al. | 89/41.05 |
| 4,096,380 | 6/1978 | Eichweber | 244/3.14 |
| 4,279,036 | 7/1981 | Pfund | 356/152 |
| 4,434,510 | 2/1984 | Lemelson | 455/617 |
| 4,603,975 | 8/1986 | Cinzori | 455/617 |

FOREIGN PATENT DOCUMENTS

| | | |
|---|---|---|
| 1529388 | 10/1978 | United Kingdom . |
| 2046550 | 11/1980 | United Kingdom . |
| 2113939 | 7/1985 | United Kingdom . |
| 2133652 | 5/1986 | United Kingdom . |

*Primary Examiner*—Charles T. Jordan
*Assistant Examiner*—Stephen Johnson
*Attorney, Agent, or Firm*—Cushman, Darby & Cushman

[57] ABSTRACT

Information transmitting method using a laser beam projector which may form part of an optical missile guidance system on board a ship say. For missile guidance, the laser beam is so scanned over a field containing the target and missile that the missile receives successive glimpses of the beam at times dependent on guidance and other information to be sent to it. For transmitting information, to another ship say, the same beam projector is used to scan a field containing a detector on board the other ship so that the detector receives successive glimpses of the beam at times dependent on the information to be transmitted.

11 Claims, 4 Drawing Sheets

Figure 1:
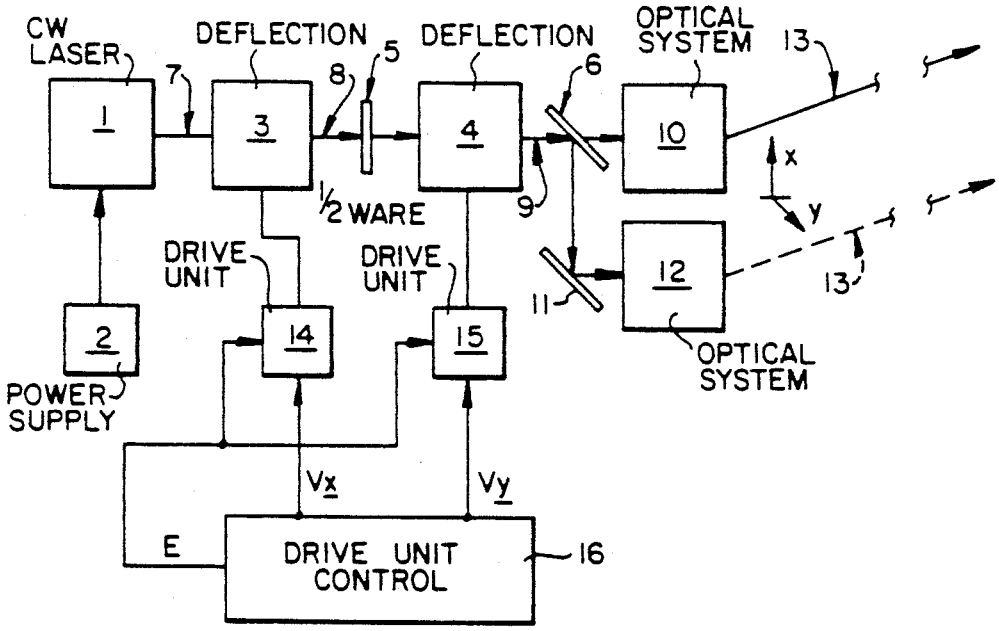

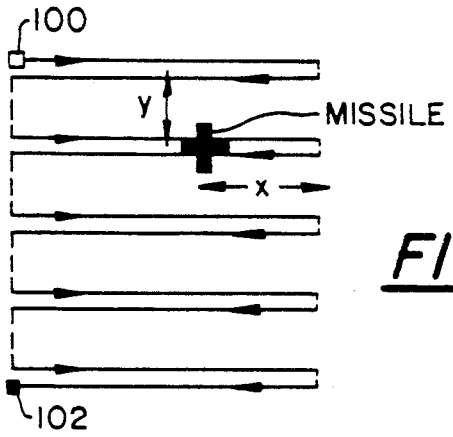
FIG. 3
FIG. 4
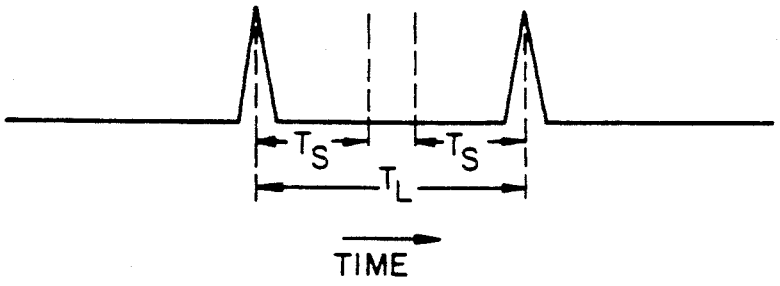
FIG. 5
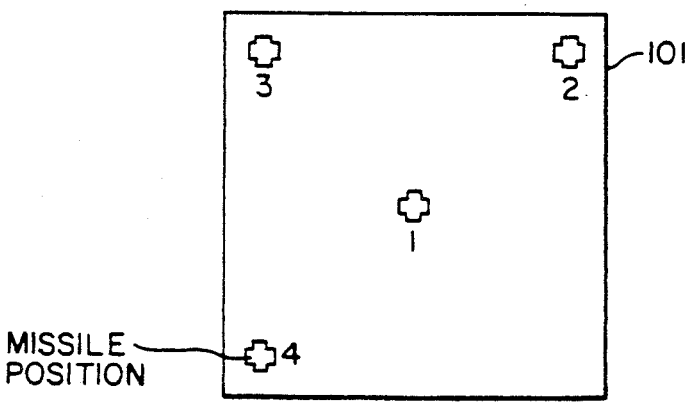

FIG. 7
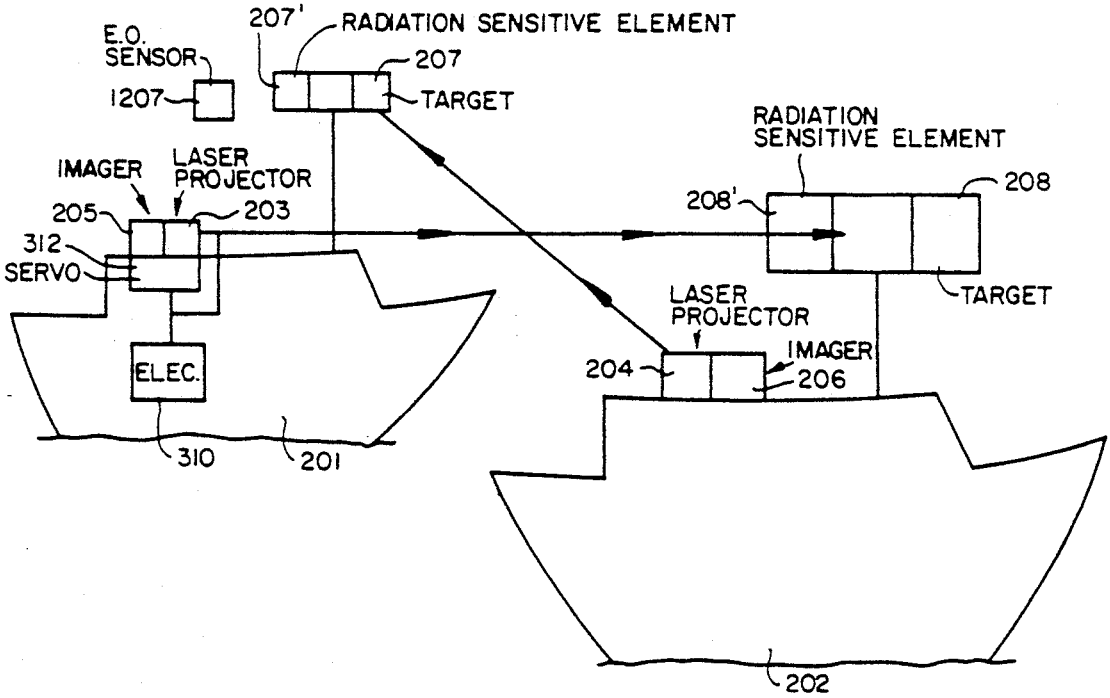
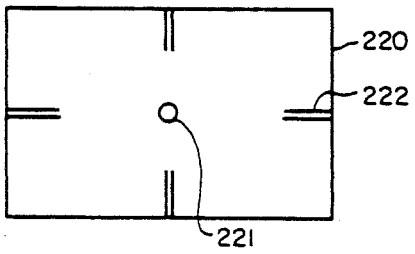
FIG. 8

INFORMATION TRANSMISSION SYSTEM

This is a continuation of application Ser. No. 795,448, filed Nov. 6, 1985, which was abondoned upon the filing hereof.

This invention relates to an information transmission system of the kind wherein a projected beam of radiation traces out a scanning path over a field-of-view of the beam projector and wherein sensing apparatus on-board an object to which information is to be transmitted, for example a missile, is able to decode the transmitted information (for example guidance information indicative of the position of the object within the field of view) by reference to the times when it glimpses the beam. The invention also relates to a guidance information transmitting station for use in such a system.

Our UK Patent No. 2,113,939 and our UK Patent application No. 2133652 disclose a beam rider guidance system wherein a projected laser beam is so scanned over the field-of-view that it becomes incident on the article to be guided twice in succession with the time interval between the two incidences being dependent upon the position of the article within the field-of-view. Thus, by timing the interval between two successive glimpses of the beam, sensing apparatus on-board the article can determine its actual position within the field-of-view and hence, for example, steer the article towards some desired position. The beam projecting apparatus can include scanning control means which is operable for steering the article within said field-of-view and/or for passing command information thereto by introducing a controllably variable time delay into the scanning process such that said time interval becomes also dependent upon said time delay.

According to one aspect of the invention, there is provided a method of passing information from a transmitting station to a receiving station, on board respective ships for example, in which method a laser beam projector sited at the transmitting station is used to project a laser beam towards a laser radiation sensitive element at the receiving station and said laser beam is controlled so as to cause said sensitive element to produce a signal containing said information.

According to another aspect of the invention, there is provided an optical missile guidance command installation including a laser beam projector for projecting a laser beam and for scanning said beam over a field-of-view, and control means for controlling said projector to guide a missile towards a target, characterised in that the installation is provided with further beam projector control means operable, as an alternative to the first-mentioned control means, for receiving an information bearing signal and for so controlling the beam projector that a remote laser radiation sensitive element positioned for receiving said beam will respond to the beam to reproduce said signal.

Figure 2:
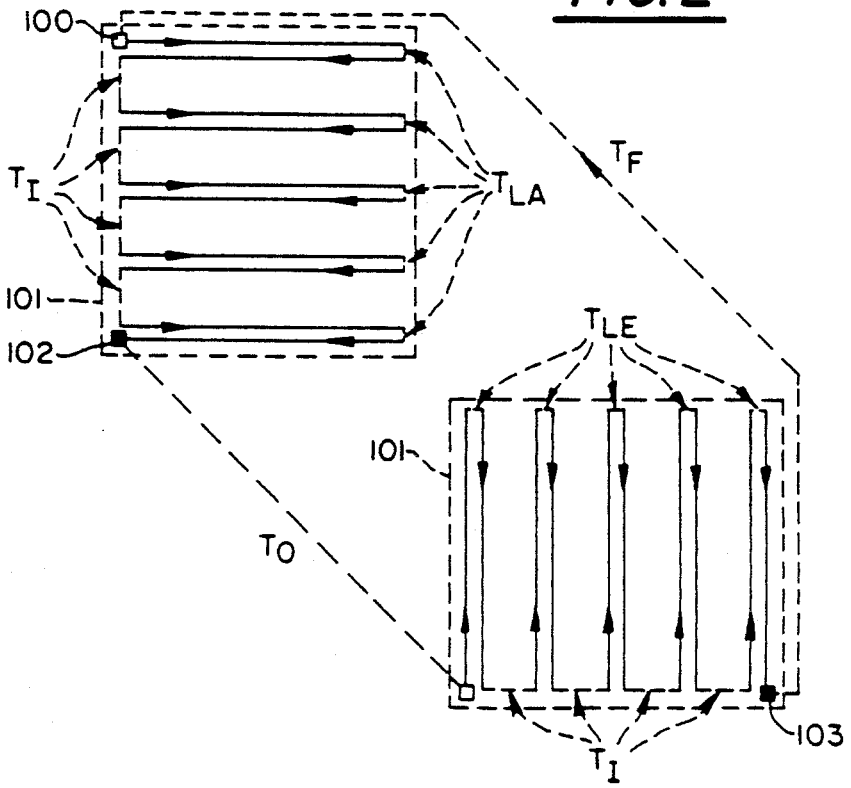
Figure 6:
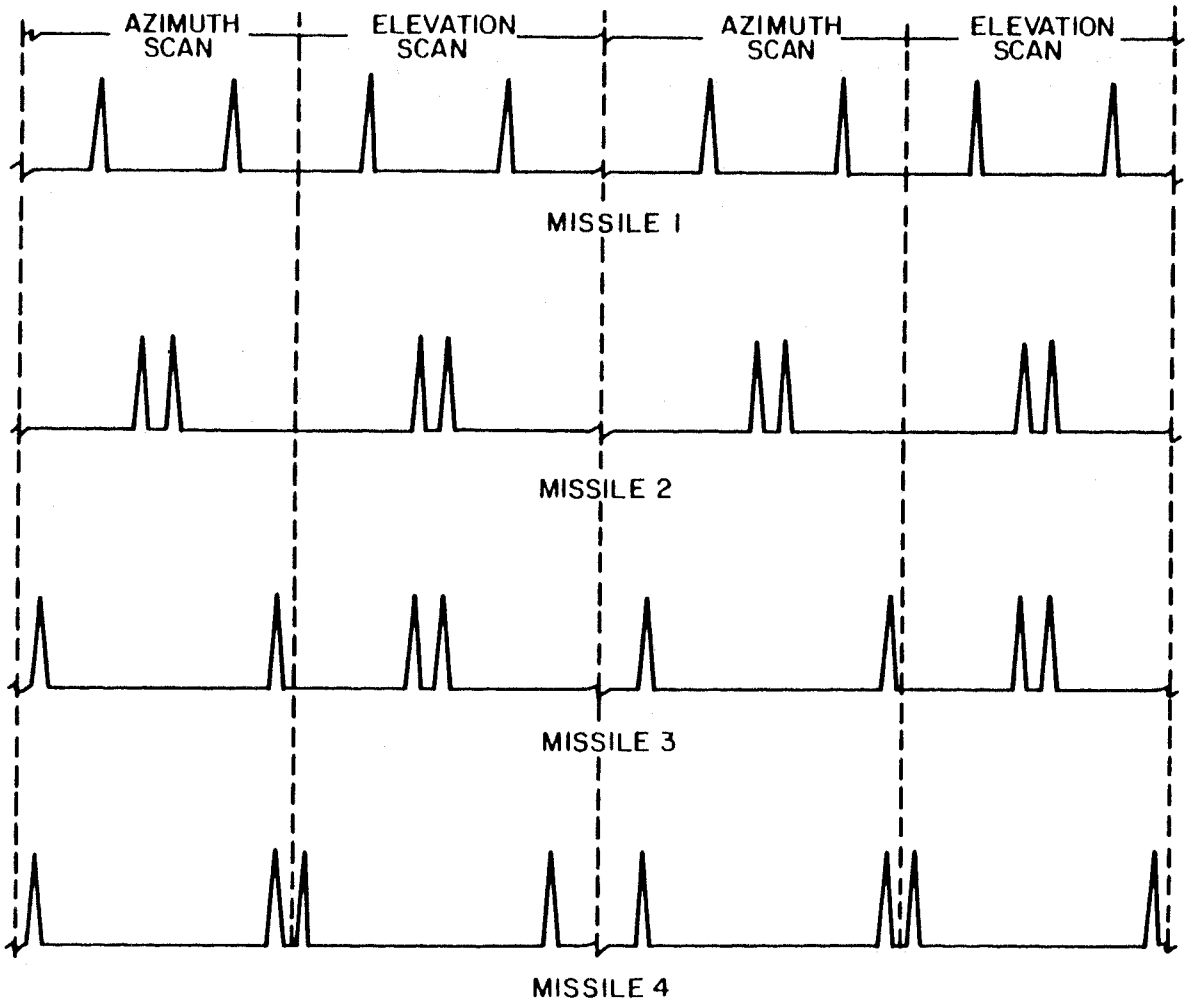

For a better understanding of the invention, reference will now be made, by way of example, to the accompanying drawings, in which:

FIG. 1 is a diagram illustrating the operation and, in simplified form, the construction of an optical beam rider missile guidance system, FIG. 2 is a diagram illustrating the scanning path traced out by a radiation beam projected by the FIG. 1 system, FIG. 3 is a diagram, including a part of FIG. 2 and illustrating the timing of glimpses of the projected beam by a receiver on board a missile guided by the FIG. 1 system, FIG. 4 shows two signal pules which might be formed in the receiver, FIG. 5 is a diagram showing a field-of-view of a guidance beam projector with four missiles positioned therein, FIG. 6 comprises four signal timing diagrams showing the timing of beam glimpses by respective ones of the four missiles of FIG. 5.

FIG. 7 is a diagrammatic view illustrating how two ships might communicate with one another, an FIG. 8 is a diagrammatic view of a target used on board each ship of FIG. 7

Referring to FIG. 1, the illustrated guidance system comprises a ground station incorporating a continuous wave laser 1 with an associated power supply 2, two acoustic-optic deflector cells 3 and 4, a half-wave plate 5 and a switchable mirror 6. As is know, an acoustic-optic deflector cell is operable to receive a beam of light, such as the beam 7 from laser 1, and in response to a high frequency drive signal, for example in the Mega-Hertz or GigaHertz range , to deflect some of the light energy in a single place to form a so-called "first-order" beam, the deflection angle being substantially proportional to the frequency of the drive signal. The cell 3 in FIG. 1 is arranged for receiving beam 7 and to direct the first-order beam 8 produced by the cell 3 to pass via the half-wave plate 5 to the cell 4. The function of the plate 5 is to rotate the polarization plane of beam 8 and hence render it correct for the proper operation of cell 4 as will be understood by those skilled in the act. The first order beam 9 produced by cell 4 passes to a switchable mirror 6. The zero-order beam (not shown) from each cell, i.e. the undeflected portion of the beam received by each cell, is passed to a respective energy absorbing medium (not shown).

The switchable mirror 6 is controllable to pass the first-order beam 9 from cell 4 to a first output optical system 10 or, via a further mirror 11, to a second output optical system 12. One of the optical systems 10 and 12, called the "gather optics", has a comparatively wide field-of-view and is used to pick-up a just launched missile and guide it into the smaller field-of-view of the other system, the "tracker optics", which is then used to quide the missile through the remainder of its flight.

The cell 3 is arranged so that variation of the angle through which this cell deflects beam 8, varies the elevation direction of the output beam 13 which is actually emitted from whichever of the two optical systems 10 or 12 is in use. Meanwhile, the cell 4 controls the azimuth direction of the output beam 13. The drive signals for the two cells are provided by respective drive units 14 and 15 each comprising a gate circuit, a voltage controlled oscillator and possibly also an amplifier output stage (the elements of each drive unit are not separately shown). In each unit, the gate circuit is operable in response to a common enable signal E from a drive unit control circuit 16 to pass the output of the voltage controlled oscillator to the associated deflector cell, the frequency of that output being substantially proportional to the magnitude of a respective one of two control voltage signals Vx and Vy produced by circuit 16.

When the drive signals to cell 3 and 4 are gated off, substantially all of the energy received by each cell emerges with the respective zero-order beam, i.e. undeflected, and passes to the energy aborbing medium. During such times, therefore, the output beam 13 is shut off. When the drive signals are gated on, the beam 13 is emitted with its elevation and azimuth controlled by the respective magnitudes of the signals Vx and Vy.

In use, the signals Vx and Vy are varied to cause beam 13 to scan repeatedly a field 101, of rectangular cross-section, within the field-of-view of the operative output optical system.

The successive scans are excuted according to a cyclic sequence of two linewise scan patterns as shown in FIG. 2. The sequence comprising a first or azimuth scan which commences at the top left-hand corner 100 of the scanned field 101 and the azimuth direction to the beam is then varied so that it scans across towards the right of the field. After a short delay time $T_L$, it then executes a reverse scanning movement, i.e. not a flyback movement, with the same elevation so that it comes back to its starting point whereupon the beam elevation is stepped downwards. Following a further short delay $T_I$a, further sequence of a right-going forward scan, short delay $T_{LA}$, and a left-going reverse scan is executed. The beam elevation is then stepped down again, a further forward and reverse scan executed, and so on. The beam ends up at the bottom left-hand corner 102 of the field and, after a suitable delay $T_O$, starts to execute the second or elevation scan comprising a series of up and down scan movements, the azimuth direction of the beam being stepped from left to right between each pair of up and down scans. As before, each upwards scan and the following downwards scan are separated by delay $T_{LE}$ while each downward scan and the following upward scan are separated by a delay $T_I$ (during which the azimuth direction is stepped). The beam then ends up at the bottom right hand corner 103 of the field. From this position it returns to the original starting point 100 and, after a further predetermined delay $T_F$ repeats the whole sequence. A missile within the field 101 thus receives two closely spaced laser sightings while the azimuth scan is executed and then another two glimpses of the laser beam while the elevation pattern is executed.

First consider the situation where the beam sensor or receiver of the missile sits exactly on a scan line of the azimuth pattern as shown in FIG. 3. As the beam scans across it, the receiver will form two closely spaced signal pulses as shown in FIG. 4, the first corresponding to the forward line scan and the second to the reverse line scan. By timing the interval $T_{PA}$ between these two pulses and knowing the scan rate, then it is possible to derive a measure of the distance x between the missile and the right-hand edge of the scan pattern as follow:

$$T_{PA}=2T_S+T_{LA}$$

where $T_{LA}$ is the time delay between the completion of the forward scan and the start of the reverse scan and $T_S$ is the time it takes to scan the distance x from the detector to the right-hand edge of the pattern. Now $T_S=x/S_R$ is the line scan rate.

Hence, $$x = \frac{(T_{PA} - T_{LA})S_R}{2}$$

Similarly, the distance y between the missile and the top edge of the scan pattern can be obtained as $$y = \frac{(T_{PE} - T_{LE})S_R}{2}$$

where $T_{PE}$ is the time interval between the two pulses formed during the elevation scan.

The control apparatus on board the missile is operable to steer the missile to some predetermined position within the scan pattern, i.e. to some position at which $T_{PA}$ and $T_{PE}$ are equal to predetermined values. Steering the missile around the scan pattern from the ground station is performed by fooling the receiver into thinking that it has drifted away from the predetermined position within the scan pattern it was instructed to take up. This is achieved by controllably varying the delays $T_{LA}$ and $T_{LE}$ (i.e. the delays between the forward and reverse line scan of the azimuth and elevation patterns respectively) to make it appear to the missile that x and y have changed and hence that it has deviated from its desired position within the scan pattern.

In particular, if $T_{LA}$ and $T_{LE}$ are increased, then both x and y will apparently decrease, and so the missile will believe it is closer to the top right-hand corner than it really is. Thus, it will move away from this corner. If the delays are increased, the reverse happens and the missile will move towards the top right-hand corner.

Since the scan pattern and the delays are both generated electronically, the delays could also be altered from frame to frame if desired. This technique can be used for the guidance of multiple missiles.

Whenever a missile enters the scan pattern, it immediately looks for the delay interval $T_F$ between data frames (i.e. an azimuth plus elevation sweep) when no information is transmitted, so that it can lock-on to the scanning sequence. For the control of a single missile, this delay occurs immediately after every transmission of a complete data frame. For multiple missile control, however, this is no longer the case because, the frequency of occurrence depends on the number of missiles under simultaneous guidance. If for example four missiles are in flight at the same time, then the delay interval will occur after every fourth data frame.

The first missile enters the scan pattern, waits for the (synchronising) interval $T_F$, locks-on to the pattern and then proceeds to look for the first set of four data pulses. It gathers these and extracts its guidance information from them by measuring the azimuth and elevation pulse intervals $T_p$. These intervals will of course contain the delays $T_{LA}$ and $T_{LE}$, the exact values of which will depend on where in the pattern the missile is to be directed. The receiver then counts the following three sets of four data pulses in order to maintain synchronisation but ignores the guidance data they contain. Instead, it awaits the next delay interval $T_F$ which it then uses to confirm or re-establish lock-on with the pattern sequence. Once again it looks for the first set of four data pulses which as before contain it guidance information.

The second, third and fourth missiles proceed in exactly the same way. However, after locking-on to the pattern sequence, the second missile ignores the first, third and fourth guidance data and uses only the second set. This set may contain different values for the delays $T_{LA}$ $T_{LE}$ depending on the aim point chosen for this missile. Similarly, the third missile would only use the third data set and the fourth only the last set; the delays $T_{LA}$ and $T_{LE}$ would once again be individually selected.

FIGS. 5 and 6 give an example of how the same scan pattern would look to each of the four missiles if they took up the positions illustrated. It can be seen that the sequences of pluses are quite distinct for each of the positions shown.

The scan patterns so far considered have all been concerned with transmitting accurate guidance date to the missile. However, the concept of variable delay times can also be usefully employed to transmit other coded information (e.g. range, or commands to perform other manoeuvres) to the missile. In one useful scan pattern for transmitting such auxilliary information, the first line is scanned in azimuth from left to right in the same way as in the azimuth pattern of FIG. 2. Then, however, after a suitable delay $T_V$ this same line is re-scanned in exactly the same way (i.e. left to right, with exactly the same line scan rate). Only after this second scan has been completed is the scan line incremented in elevation. The next line is similarly scanned twice and this continues until the entire area to be scanned has been covered.

If the delay $T_V$ is constant, it can be shown that the time interval between two consecutive pulses observed by the missile receiver will be constant no matter where the pattern the missile may be, i.e:

$$\begin{aligned}\text{Time between pulses} &= \text{Time to scan one line} + T_V + \\ &\quad \text{Time to flyback} \\ &= \text{Constant.}\end{aligned}$$

However, if $T_V$ is a variable quantity, then any variation in the time interval between the pulses will be solely due to changes in the value of the delay $T_V$ and so this delay becomes available for carrying coded information to the missile.

Because the scan patterns for an acoustic-optic laser scanner are electronically generated, then this coded information scan pattern can be very easily interlaced with the guidance scan patterns. The missile would enter the scan pattern and lock-on to the interframe delay interval $T_F$ (i.e. the synchronisation segment) as previously described. The first pulse it sees would then simply be the coded information pulses. After a suitable delay, these would be followed by the normal four guidance pulses. Provided that the receiver logic is programmed accordingly, there is no theoretical limit to the number or frequency of the coded information scans that can be trasmitted to the missile. In practice however, there will be an upper limit due to the necessity of ensuring that sufficient guidance data is always received by the missile.

As will be appreciated, this invention is not limited to missile guidance, but is instead applicable to many situations where some object is to be guided or to guide itself relative to a defined position. By way of example, a scanning system according to the invention might be used, for example for guiding a spacecraft from a ground position or from a position on board another spacecraft, or it might be used for guiding, for example a helicopter trying to land on an offshore oil platform. In the latter case, probably the position information would be simply presented to the helicopter pilot rather than being used for automatic control as would be the case with a missile and probably also a spacecraft.

Finally, it will be realized that it may be possible to use, perhaps with some adaptation, a mechanical type of scanning mechanism, e.g. one incorporating moving mirrors, to provide a sequence of such scan patterns that the time between incidences of radiation on a point within the scanned field is dependent upon the position of the point. However, the use of a non-mechanical deflection system, particularly the acoustic-optical deflector system described herein and shown in the drawings is much preferred since thereby it may be that synchronization of the various movements making up the chosen scan patterns is made simpler and the achievability of scan pattern changes, the speed of scanning and the scan repetition rate, achievability of control and programmability of the scanned field-of-view and other parameters, and the accuracy of the positional information are all improved.

In FIG. 7, two ships 201 and 202 with a line of sight from one to the other are fitted with respective scanning laser beam projectors 203 and 204, respective thermal imagers 205 and 206, and respective electro-optical 'targets' 207 and 208, each of which targets comprises some form of infra-red emissive marker, a hot-wire for example, detectable by the thermal imager on board the other ship and an adjacent electro-optical sensor 207 capable of detecting the laser emission from the other ship.

The laser information field, i.e. the field scanned by the laser beam, on board ship 201 will be normally locked onto the target on ship 202 while the system is in its electro-optical automatic tracking mode (described later). Should this prove difficult, in rain at night for example, the thermal imager can be used to provide an optical sight line.

The laser beam projector and thermal imager on board each ship are positioned adjacent one another and are coupled together so that the area imaged by the thermal imager is at least approximately boresighted wit the area scanned by the laser beam.

When the ship 201 wishes to communicate with ship 202, it uses its thermal imager 205 to find the target marker of ship 202 and then the boresight of the imager 205 is aligned with or aimed at that marker. The target sensor of ship 202 will then be within the area scanned by the laser beam and will glimpse the beam each time the scan pattern is executed, thereby producing a series of electrical pulses. The scan pattern executed by the laser beam is such that the time interval between two consecutive glimpses of the laser beam by the target sensor on ship 202, and hence also the time between two consecutive pulses produced by the sensor, are indicative of the position of the target sensor relative to the area scanned by the laser beam as described earlier herein. The pulses, or signal encoded with positional information which can be derived from those pulses, are then re-transmitted back to ship 201 from ship 202. Since, in the illustrated case, the ship 202 is equipped in the same way as the ship 201, the re-transmission would probably be done by the ship 202 using its own laser beam projector and thermal imager to set up a similar line of communication back to the target sensor on board ship 201. However, the re-transmission could be by way of some alternative form of signal communication which may be available. The re-transmitted information is then used within ship 201 to correct for any errors in the relative positioning of the laser beam scan and the target sensor of ship 202. For example, if the original pulses themselves are simply re-transmitted, then appropriate processing equipment on board ship 201 is used to compare the actual timing of the pulses with that predicted. To overcome any such relative position errors, the laser beam projector can be physically moved relative to the thermal imager or preferably, since then no mechanical adjustments are involved, the various end-of-line delays incorporated in the scan pattern can be adjusted so that at least the apparent relative position becomes correct.

Having obtained the correct actual or apparent relative positioning of the laser beam raster, the communication proper can commence. This is done by causing the laser beam projector on ship 201 to execute a sequence of scan patterns, the sequence possibly continuing to include a pattern similar to that previously executed so that a continuing check can be kept on the relative positioning of projector and target sensor, but also including one or more scan patterns for which the end-of-line delays are so set that the between-pulse intervals measured in ship 202 carry the information to be communicated. After the initial position correction, and at intervals or throughout the signal communication, the two ships may exchange 'hand-shake' signals to confirm verification of received signals and verify proper operation of the equipment.

As shown in FIG. 8, the target on board each ship can comprise a support frame 220, which could be position-stabilised by say a gyroscopic stabilising arrangement (not shown) with an electro-optical sensor element 221 positioned at the centre of the frame and one or more infra-red emissive marker elements 222, for example infra-red hot wire devices. The target is best positioned relatively high up in the ship's superstructure, say at or near the top of a mast as shown in FIG. 7.

If, as is preferred, the laser beam projector on board each ship comprises an acousto-optic deflector arrangement for causing the beam to execute the scan pattern, there becomes easily available a somewhat modified form of communication. An acousto-optic deflector simply deflects the laser beam in accordance with the deflection control signals applied to it. In order to execute a scan pattern, the control signals are made to have an appropriate repetitive waveform. Thus, when the projector is to be used for communication, this repetitive waveform could be replaced by a control signal which simply maintains the laser beam aimed at the target on board the other ship. Initial aiming may again be achieved by use of a thermal imager on board ship 201 to find and provide approximate alignment with the target of ship 202. Fine adjustment can then be carried out by feedback, from ship 202 to ship 201, of the amplitude of the signal generated by the target sensor of ship 202, the deflection control signals and hence the beam direction being adjusted to achieve a peak in this amplitude.

The information to be passed to the ship 202 is transmitted as an analogue amplitude modulation or as any suitable form of pulse modulation, for example pulse position or pulse width modulation, of the laser beam. The modulation is introduced into the beam by any of various known techniques, for example by making use of the amplitude modulation capability of the acousto-optic deflector arrangement itself.

Instead of maintaining the aim of the laser beam by feedback of the received beam amplitude from ship 202 to ship 201, it could be done entirely on board the ship 201, for example, by monitoring the radiation backscatter from the target of ship 202 using radiation sensitive elements 207' and 208'.

As described earlier, the laser beam projector is also usable as part of an optical missile guidance system, the laser beam then being scanned over a field-of-view containing a missile and an enemy target and the missile comprising means for sensing and timing successive glimpses of the laser beam and for using such time measurements to guide itself within the field-of-view and eventually onto the enemy target. As will be appreciated, the laser beam may also be detectable by the enemy target thereby alerting the enemy to the impending threat and also possibly disclosing the position from which the beam originates. To avoid this the co-ordinates of the enemy target position, supplied by whatever apparatus is used to detect and track the enemy target (a radar system perhaps or a thermal imager), are fed to the laser beam transmitter which uses them to ensure that no laser power is transmitted to the enemy target, for example the transmitter can so amplitude modulate the beam that while the enemy target position itself is being scanned or would have been scanned, the laser beam is turned off. Meanwhile the missile is guided at least initially along an off target axis trajectory. Eventually the missile has to be moved into alignment with the target axis, i.e. the line of sight from the beam projector to the enemy target, at which point the amplitude modulation can cease so that the missile can continue to receive guidance from the projector. This at least reduces the time during which the enemy target can detect the beam. Alternatively, the missile could be provided with a homing head or seeker. In this case the laser beam projector, with the amplitude modulation to avoid its location by the target maintained, is used only to guide the missile along its initial off-axis trajectory and then, by physically moving the projector or by adjusting the scan pattern end-of-line delays, to slew the missile onto the target sightline. After some fixed flight time, or when the missile has determined that the laser beam intensity has become less than a predetermined threshold, it changes over to guidance by its homing head. The advantage of the latter system is that, although the missile requires a homing head, since the missile is guided at least approximately towards the target by the laser beam projector, that homing head can be a much lighter and less expensive device than would be the case if it were the sole means of guiding the missile. Fuzing of the missile may be initiated by the lapse of some predetermined flight time or by the loss of the laser beam or it may be done positively by commands transmitted as variations of the laser beam scan pattern as described earlier.

A further method of avoiding or reducing the chance of disclosure of the laser projector position, which method is particularly suitable for gun-launched projectiles having a terminal guidance capability, is to leave the laser projector switched off for the initial or ballistic phase of the projectile trajectory and to switch it on only during the terminal phase when it is needed.

As mentioned, a missile guidance system might comprise a thermal imager for detecting and tracking an incoming target and a laser beam projector for guiding missiles to the target, the projector being controlled by the imager so as to maintain the beam scanned area properly positioned with respect to the target. The thermal imager and beam projector are preferably assembled on the same servo-base 312. This permits the use of an inner loop solid state electronic correction using electronics module 310 of the various delay times incorporated in the execution of the scan pattern and hence correction of the laser field angles so as to compensate any servo errors and for the target not being centred within the field-of-view of the imager. Therefore, the electronics module 310 allows boresighting the laser projector with the thermal images. This in turn permits the servos to be deliberately misaligned thereby permitting earlier illumination of the missile without affecting the information received thereby.

Throughout this specification, the term missile also includes the so-called GLGP's (gun launched guided projectiles).

I claim:

1. A method of passing information between missile guidance systems, comprising the steps of:

providing a first laser beam missile guidance system and a second laser beam missile guidance system, each system having a laser beam projector means for scanning a laser beam over a field of view and control means for controlling said laser beam projector means to guide a missile towards a target, both systems being capable of independently operating as optical missile guidance systems;

scanning with each said guidance system via a laser beam projector means over a field of view;

controlling via a control means said laser beam projector means to guide a missile towards a target, both systems being capable of independently operating as optical missile guidance systems;

using a first laser beam projector means sited at said first system to project a laser beam including information towards a laser radiation sensitive element at said second system;

controlling said laser beam to cause said sensitive element to produce a signal including said information;

establishing a non-communication time when said first and second systems are not communicating;

using said first laser beam projecting means at said non-communicating time to guide a missile; and using said second laser beam projecting means at said non-communicating time to guide a missile.

2. A method according to claim 1 comprising the further step of targeting the laser beam on said laser radiation sensitive element at said second system by utilising feedback signals from the second system.

3. A method according to claim 2 wherein there is a further laser radiation sensitive element positioned at the first system; and comprising the further step of supplying said feedback signals by the second system to the first system by projecting a laser beam from the laser beam projector positioned at the second system towards said further laser radiation sensitive element.

4. A method according to claim 3 where there is a thermal imager coupled to said laser beam projector, and comprising the further step of approximately boresighting the area imaged by the thermal imager to the area covered by the laser beam.

5. A method according to claim 2 where there is a thermal imager coupled to said laser beam projector, and comprising the further step of approximately boresighting the area imaged by the thermal imager to the area covered by the laser beam.

6. A method according to claim 1 comprising the further step of targeting the laser beam from the first system on the laser radiation sensitive element at the second system by monitoring radiation backscatter from said second system.

7. A method according to claim 6 where there is a thermal imager coupled to said laser beam projector, and comprising the further step of approximately boresighting the area imaged by the thermal imager to the area covered by the laser beam.

8. A method according to claim 1 where there is a thermal imager coupled to said first laser beam projector means, and comprising the further step approximately boresighting the area imaged by the thermal imager to the area covered by the laser beam.

9. A method according to claim 8 wherein the thermal imager and the first laser beam projector means are assembled on a same servo-base, and comprising the further step of:

using inner loop solid state electronic correction of laser field angles to correct the position of the first laser beam projector means in response to signals from the thermal imager.

10. A method according to claim 8 comprising the further step of passing information from the first system to the second system by scanning the laser beam over a predetermined field of view in which the laser radiation sensitive element is located by varying end-of-line time delays during the scanning movement according to the information to be transmitted.

11. A method according to claim 8 wherein information is passed from the first system to the second system by the laser beam towards the laser radiation sensitive element at the second system and modulating the beam so as to pass information from the first system to the second system.

* * * * *